United States Patent [19]

McCullough

[11] Patent Number: 4,494,311

[45] Date of Patent: Jan. 22, 1985

[54] MEAT TRIMMING KNIFE

[76] Inventor: Timothy J. McCullough, Box 295, Lake Rd., Vermilion, Ohio 44089

[21] Appl. No.: 434,128

[22] Filed: Oct. 13, 1982

[51] Int. Cl.[3] ..... B26B 7/00

[52] U.S. Cl. ..... 30/276

[58] Field of Search ..... 30/276, 347, 389, 329, 30/337; 17/1 G, 67

[56] References Cited

U.S. PATENT DOCUMENTS

| | | | |
|---|---|---|---|
| Re. 25,947 | 12/1965 | Bettcher | 30/276 |
| 1,552,771 | 9/1925 | Sparks | 30/329 |
| 3,269,010 | 8/1966 | Bettcher | 30/276 |
| 3,852,882 | 12/1974 | Bettcher | 30/276 |
| 4,170,063 | 10/1979 | Bettcher | 30/276 |
| 4,178,683 | 12/1979 | Bettcher | 30/276 |
| 4,198,750 | 4/1980 | Bettcher | 30/276 |

FOREIGN PATENT DOCUMENTS

| | | | |
|---|---|---|---|
| 788494 | 1/1938 | United Kingdom | 17/1 G |

*Primary Examiner*—James M. Meister
*Assistant Examiner*—Douglas D. Watts
*Attorney, Agent, or Firm*—Michael Sand Co.

[57] ABSTRACT

An improved manually manipulated meat trimming knife of the type having a handpiece which terminates at one end in a concave configuration on which is mounted a ring-shaped blade holder. A locking key is slidably mounted in a keyway formed in the concave end of the handpiece and is engagable with a ring-shaped cutting blade for releasably mounting the blade on the blade holder. A spring biased pin releasably secures the key in a forward engaged position with the cutting blade. One or more tabs are formed on the blade holder and form an arcuate groove for slidably receiving and supporting the blade therein. The tabs and locking key enable the cutting blade to be removed and installed on the holder without removing or loosening any mounting or adjusting screws.

10 Claims, 8 Drawing Figures

MEAT TRIMMING KNIFE

BACKGROUND OF THE INVENTION

1. Field of the Invention

The invention relates to meat-cutting devices and particularly to a power-driven meat-cutting knife adapted to be manually held and manipulated for the quick and easy removal of meat from carcasses and bones. More particularly, the invention relates to an improved knife in which a ring-shaped cutting blade can be removed and installed on a complementary shaped blade holder mounted on the front end of the knife without removing or loosening any mounting or adjusting screws as heretofore required.

2. Description of the Prior Art

Various styles of power-driven meat-cutting tools have been devised wherein a ring blade is rotatably mounted on a holder which in turn is mounted on a manually operated, power-driven handle or handpiece. These tools have been used for some time to facilitate the removal meat from a carcass, primarily in a trimming operation or for removing the meat remains from the bones. These meat-cutting tools are either electrically or pneumatically driven. Some examples of these prior meat-cutting tools are shown in U.S. Pat. Nos. 3,269,010, 3,852,882, 4,170,063, 4,178,683, 4,198,750 and 4,324,093.

These power driven tools or trimming knives as they are generally referred to in the industry, consist of a tubular handpiece terminating in an arcuate shaped front end and formed with a hollow bore extending throughout the longitudinal length thereof. The annular blade holder is attached to the arcuate front end of the handpiece with the ring blade being removably mounted thereon by various mounting arrangements. The blade is formed with gear teeth extending around the top thereof, which are in driving engagement with a pinion gear rotatably mounted within the bore adjacent the front end of the handpiece.

In electrically driven knives a flexible cable, one end of which is connected to a motor located adjacent to the work area, enters the rear of the handle and extends through the bore and terminates in a squared end. The squared end is engaged in a complementary-shaped opening formed in the rear of the pinion gear for rotatably driving the gear. In pneumatically driven knives a squared shaft end of an air motor is engaged in the rear opening of the pinion gear for driving the gear.

These trimming knives have various size diameter blade holders and cutting blades mounted thereon depending upon the particular meat trimming operation for which the knives are to be used. One particular type such as shown in U.S. Pat. No. RE 25,947 has a blade with a diameter of approximately five inches. This blade is rotatably supported on a blade holder which is mounted on the end of the handpiece by a pair of adjusting bolts which are threadably engaged in holes formed in a curved end surface on the handpiece. A curved metal retaining member extends partially outwardly along the circumference of the blade and provides support for the blade throughout a predetermined arcuate distance. This mounting arrangement provides three separate attachments or contact points for rotatably mounting the blade on the front end of the handpiece.

Such a blade mounting arrangement has several disadvantages in that when the blade must be removed for sharpening or replacement it is difficult for the operator to perform the same at the meat cutting station since the three blade attachment or mounting bolts must be loosened, for removing the blade. These three bolts then must be adjusted to properly mount a new or sharpened blade on the handpiece. Quite often these three bolts are not adjusted properly by the operator and a binding action or excessive vibration will occur between the blade and holder effecting the efficiency of the trimming knife.

Another problem with such prior blade mounting arrangement is that the outermost end of the blade is unsupported by the blade holder and occasionally the operator will "pick up" the knife from the meat during a cutting procedure which will cause the cutting blade to move away from the blade holder permitting meat to enter therebetween causing jamming of the blade with respect to the holder.

Thus, the need has existed for an improved meat trimming knife of the type using the larger diameter blades in which the knife is provided with means for rotatably mounting the blade on the blade holder and handpiece which enables an operator to quickly and easily remove and install a blade from and on the holder without requiring any adjustment of the blade holding means and without requiring special skills for accomplishing the same. There is no known meat trimming knife of which I am aware which accomplishes these results other than my improved knife described below.

SUMMARY OF THE INVENTION

Objectives of the invention include providing an improved meat trimming knife of the type having an annular blade holder mounted on the front end of the handpiece for rotatably mounting a ring blade thereon, in which a pair of spaced arcuate-shaped tabs or a single tab is formed integrally on the blade holder and space a predetermined distance forwardly and circumferentially from the handpiece for slidably receiving a portion of the cutting blade therein, and in which a slidable locking key is mounted on the handpiece and together with the tabs enable a cutting blade to be easily removed and installed on the blade holder. Another objective is to provide such a trimming knife in which the locking key is slidably mounted in a keyway formed in the front end of the handpiece, and in which a spring biased pin is seated in a hole formed in the handpiece and is engaged in a slot formed in the locking key to retain the locking key in a forward blade retaining position.

Still another objective of the invention is to provide such an improved meat trimming knife in which the tabs are positioned a predetermined circumferential distance from the handpiece locking key whereby the center point of the cutting blade and correspondingly of the blade holder will always lie outside of the area defined by the effective arcuate section of the tabs and the chord subtended by said arcuate section. Another objective is to provide such an improved trimming knife in which the tab means can be formed integrally with the blade holder and forms an arcuate groove in the holder in which the blade is slidably supported, and in which the effective arcuate length and location of one or more tab means meets the above criteria.

A still further objective of the invention is to provide such an improved trimming knife in which the existing handpieces for both the electrically and pneumatically driven knives can be utilized without material alteration except for the forming of the locking key and keyway therein and the formation of a single hole in the handpiece for receiving the spring biased pin therein, and in which the spring biased pin will bottom out against the pinion gear mounting bushing prior to completely clearing the locking key thereby preventing the locking key from being accidentally removed from the keyway.

Another objective is to provide such an improved meat trimming knife which achieves these desired results in an extremely inexpensive manner, which eliminates difficulties existing in the art, which solves problems, satisfies needs and obtains new results, and which enables an operator to quickly, easily and efficiently change blades in seconds without requiring any appreciable skill for doing the same.

These objectives and advantages are obtained by the improved meat trimming knife the general nature which may be stated as including a handpiece having a concavely shaped front end and a handle extending in a generally radial direction rearwardly from said front end; a ring-shaped blade holder adapted to be mounted on the concave front end of the handpiece; a ring-shaped cutting blade adapted to be rotatably mounted on the blade holder; attachment means mounted on the front end of the handpiece for releasably retaining the cutting blade on the blade holder; and tab means formed on the blade holder for releasably holding the cutting blade on the blade holder, with said tab means being spaced a predetermined arcuate distance from the attachment means on the handpiece.

BRIEF DESCRIPTION OF THE DRAWINGS

Further objectives and advantages of the invention will be hereinafter referred to and/or be apparent from the following description of the preferred embodiment of the improved meat trimming knife shown particularly in the accompanying drawings and set forth in the appended claims.

Similar numerals refer to similar parts throughout the drawings.

DESCRIPTION OF THE PREFERRED EMBODIMENT

Figure 1:
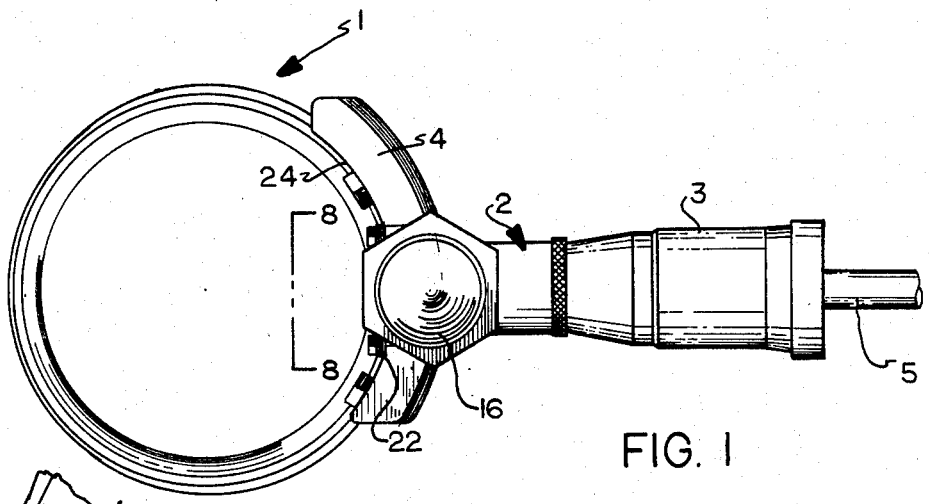
FIG. 1 is a top plan view of the improved meat trimming knife.

The improved meat trimming knife is indicated generally at 1, and is shown in FIG. 1 as an electrically driven style knife. Knife 1 includes a handpiece indicated generally at 2, having a tubular handle 3 and an arcuate-shaped blade attachment front end portion 4. Knife 1 is adapted to be connected to an electric motor by a flexible drive cable 5. The electric motor is usually supported by a hanger closely adjacent a work table on which a meat trimming operation is being performed.

Figure 3:
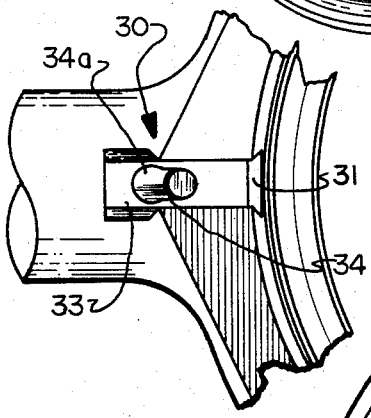
FIG. 3 is a fragmentary plan view of a portion of the trimming knife of FIG. 2 showing the locking key in retracted position.
Figure 4:
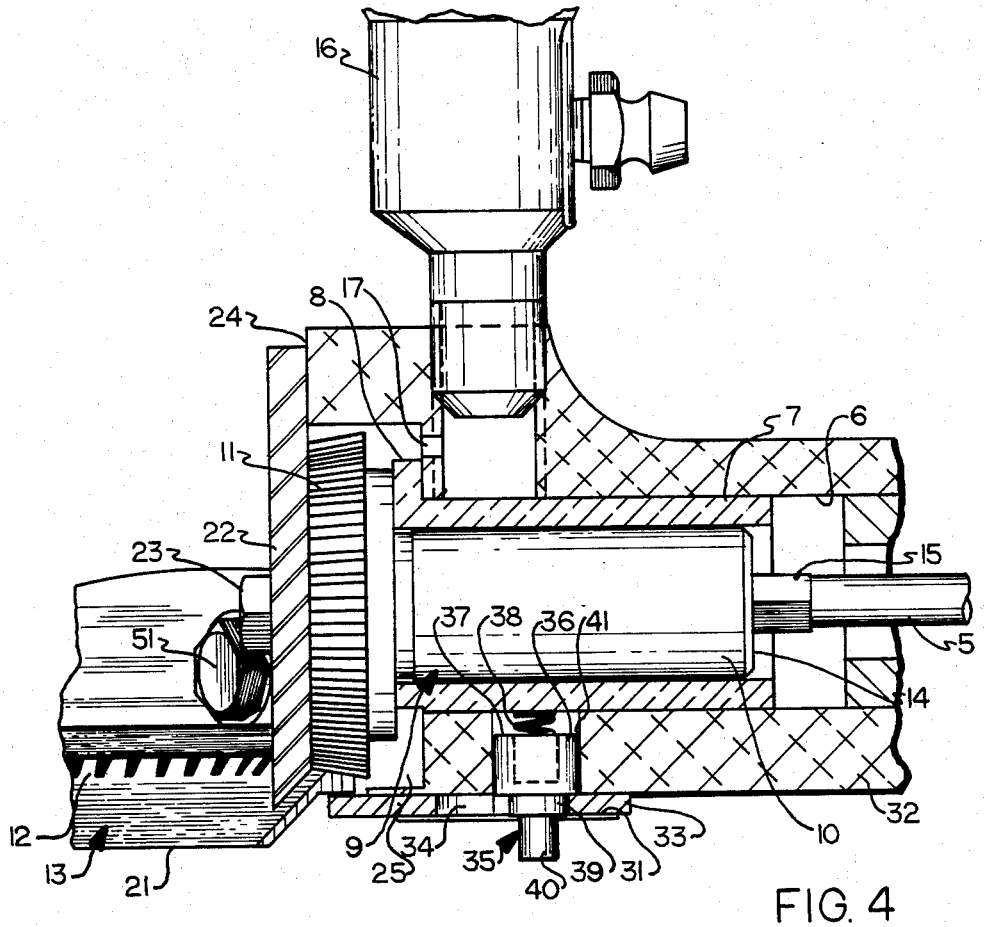
FIG. 4 is a greatly enlarged fragmentary sectional view taken of Line 4—4, FIG. 2.

Tubular handle 3 is formed with a hollow bore which communicates with a central bore 6 formed in front end 4 (FIG. 4). A bronze bushing 7 having a front flanged end 8 is mounted in bore 6 and provides the bearing surface for rotatably mounting a pinion gear 9 therein. Gear 9 includes a cylindrical shaft 10 and gear teeth 11 which meshingly engages the gear teeth 12 formed about the top surface of a ring-shaped cutting blade 13. The opposite end of gear shaft 10 is formed with a square hole 14 in which a complementary-shaped end 15 of drive cable 5 is connected. A grease cup 16 is mounted on the top of front end 4 to provide a supply of lubricating grease to meshing gear teeth 11 and 12 through a passage 17 (FIG. 3).

Blade 13 is of a usual construction with bladedriving gear teeth 12 extending circumferentially about the top of the blade. An inwardly extending annular shoulder 18 is formed between gear teeth 12 and conical blade wall 19 to slidably mount blade 13 on an improved blade holder 20. The other end of blade 13 terminates in an annular cutting edge 21. An end plate 22 is attached by a pair of bolts 23 to concave surface 24 of arcuate front end 4 of the handpiece to prevent meat from entering an annular recess 25 formed in end 4 and jamming the meshing engagement of gear teeth 11 and 12 occuring therein.

Figure 2:
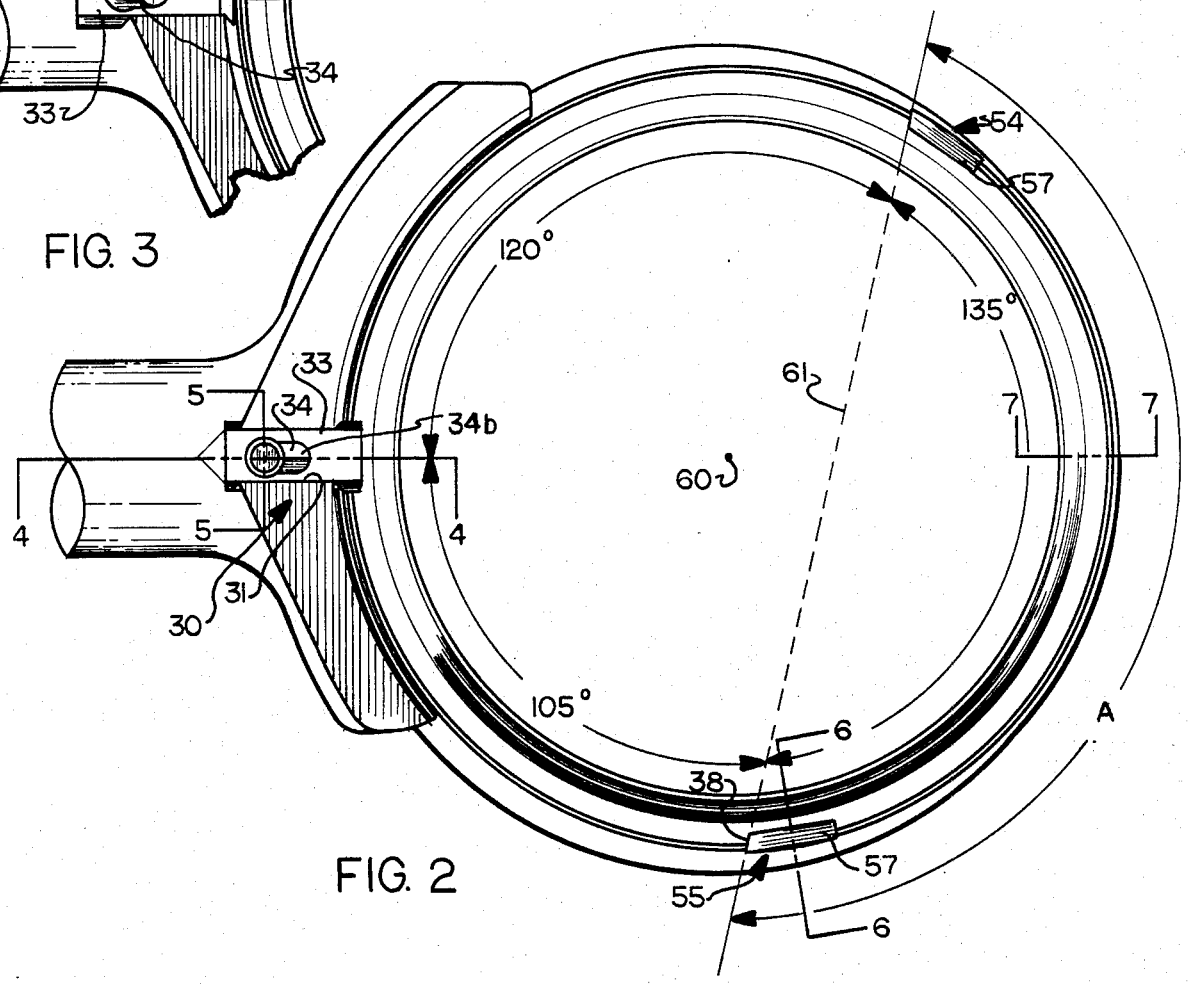
FIG. 2 is an enlarged fragmentary bottom plan view of the trimming knife of FIG. 1.
Figure 5:
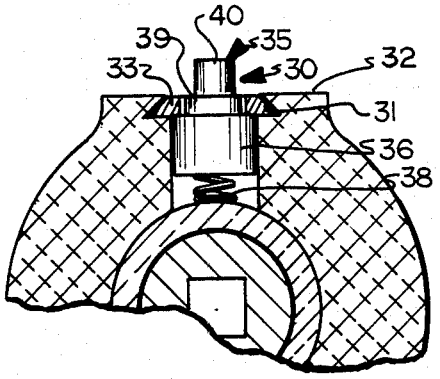
FIG. 5 is an enlarged fragmentary sectional view taken on Line 5—5, FIG. 2.

In accordancce with one of the features of the invention, a blade retaining member indicated generally at 30, is mounted on front end 4 of handpiece 2 for releasable engagement with blade 13 to mount blade 13 on the handpiece and on improved blade holder 20. Blade retaining member 30 includes a dovetail-shaped keyway 31 which is formed in the bottom wall 32 of front end 4 (FIG. 5). A complementary shaped locking key 33 is slidably mounted in keyway 31 and movable between a forward blade retaining position as shown in FIG. 2, and a rearward blade release position as shown in FIG. 3. Key 33 is formed with a keyhole-shaped central slot 34 through which a spring biased pin 35 projects for releasably maintaining key 33 in its forward blade locking position and for preventing key 33 from being accidentally displaced or removed from keyway 31.

Pin 35 includes an inner cylindrical section 36 having a hollow interior 37 for receiving a coil compression spring 38 therein. Pin 35 further includes an intermediate cylindrical section 39 and an outer cylindrical section or button 40. Pin sections 36, 39 and 40 decrease in diameter as as shown in FIG. 4. Inner section 36, in addition to providing a seat for spring 38, prevents ejection of pin 35 from within its mounting hole 41 formed in bottom wall 32 of handpiece end 4 since the diameter of pin section 36 is larger than the width of key slot 34. The diameter of intermediate pin section 39 is almost equal to the diameter of the circular portion 34*a* of key slot 34 and is adapted to extend into slot portion 34*a* when locking key 33 is in its forward blade engaging position to prevent retraction of key 33 until pin 35 is depressed. To retract key 33, pin 35 is depressed, whereupon key 33 can be manually retracted with outer pin end 40 extending through the straight portion 34*b* of slot 34. Outer pin end 40 limitsthe rearward retraction of key 33 as shown in FIG. 3. Another feature of blade retaining member 30 is that the spacing between the bottom of pin section 36 and gear bushing 7 is less than the length of pin sections 39 and 40 which results in pin 35 bottoming out against bushing 7 before pin end 40 clears key slot 34.

Figure 8:
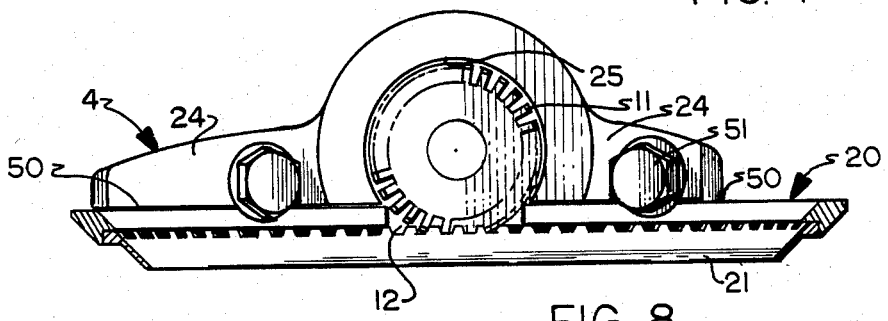
FIG. 8 is an enlarged fragmentary elevational view looking in the direction of arrows 8—8, FIG. 1.
Figure 7:
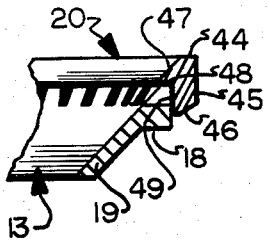
FIG. 7 is an enlarged fragmentary sectional view taken on Line 7—7, FIG. 2.

Improved blade holder 20 has an annular or ring-shaped configuration complementary to cutting blade 13. Blade holder 20 may be a continuous ring or have a split configuration as shown in FIG. 8 without affecting its operation or the concept of the invention. Holder 20 preferably includes a flat annular top surface 44, an outer side surface 45, a downwardly inwardly extending conical surface 46, and a conical top upper surface 47 extending throughout most of its circumference (FIG. 7). An annular inner shoulder 48 extends generally throughout the circumference of holder 20 and is connected with a blade retaining wall 49 which merges with conical wall 46.

Holder 20 is adapted to be seated in an arcuate groove 50 formed in concave surface 24 of handpiece end 4 (FIG. 8) and is clampingly retained therein by a pair of mounting bolts 51. Concave surface 24 and arcuate groove 50 extend throughout an arcuate length of approximately 100° and thus provides a generally rigid mounting for blade holder 20 on front end 4 of handpiece 2.

Figure 6:
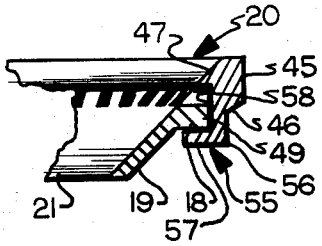
FIG. 6 is an enlarged fragmentary sectional view taken on Line 6—6, FIG. 2.

In accordance with another of the main features of the invention, blade holder 20 includes a pair of spaced tabs 54 and 55 formed integrally therewith (FIGS. 2 and 6). Tabs 54 and 55 are generally similar to each other and each includes a downwardly extending outer side wall 56 and an inwardly extending bottom wall 57 which forms an arcuate groove 58 for slidably receiving annular shoulder 18 of blade 13. Shoulder 18 is slidably supported on bottom tab wall 57 as shown in FIG. 6. Tabs 54 and 55 provide a pair of spaced blade supporting and retaining areas on the blade holder spaced arcuately from the handpiece blade retaining member 30. Tabs 54 and 55 together with key 33, provide three spaced areas or surfaces for supporting blade 13. This three point or area suspension system defines a plane which provides for the proper mounting and alignment of blade 13 on holder 20.

Each tab 54 and 55 may have an arcuate length of approximately 15° with tab 54 being spaced approximately 120° from locking key 33 and 135° from tab 55. Correspondingly, tab 55 is located approximately 105° from locking key 33. These circumferential spacings of the tabs from key 33 and from each other may vary so long as the effective arcuate length of the spaced tabs is less than 160. This efffective arcuate length is the outer arcuate distance between the tab ends indicated by line A. Also, the tabs are positioned on holder 20 so that an imaginary centerpoint 60 (FIG. 2) of blade 13 and holder 20 lies outside of the area defined by the effective arcuate tab length and a chord 61 that is subtended by this arcuate section.

The operation of improved trimming knife 1 and particularly the blade mounting means thereof is described below with particular reference to FIG. 2. An operator, to install a blade 13 on blade holder 20 will move locking key 33 to its retracted position of FIG. 3, and with the knife being in an inverted position as shown in FIG. 2 will slide the blade beneath the bottom walls 57 of tabs 54 and 55 "snapping38 blade 13 in a retained position on blade holder 20. Locking key 33 then is moved manually forwardly in keyway 31 to the blade locking position of FIG. 2 whereupon pin 35 will move outwardly from hole 41 to the position shown in FIG. 4 to secure key 33 in its forward blade engaging position.

To remove blade 13 from holder 20 a reverse procedure is carried out. Pin 35 is depressed manually a sufficient distance to enable key 33 to be retracted from its forward position of FIG. 2 to the position of FIG. 3 after which the operator will lift upwardly on the portion of blade 13 that is located adjacent handpiece end 4 which will "pop" blade 13 out of its engagement with tabs 54 and 55.

The blade installation and removal procedure described above can be performed in a matter of seconds by an operator at his work table without requiring any skill. More importantly there are no bolts, screws or plates that must be adjusted to properly position the blade on the holder as in prior trimming knives.

Accordingly, improved trimming knife 1 provides a device which enables a cutting blade to be mounted on and removed from a blade holder quickly, conveniently and without requiring any special skills, which enables both electrically and pneumatically driven trimming knife handpieces to be used without material alteration except for the machining of a dovetailed keyway in the front end portion thereof and the mounting of a spring biased pin in a hole 41. Likewise the blade holder requires only the forming of one or more tab means thereon for releasably holding the outer arcuate section of the cutting blade.

If desired, tabs 54 and 55 can be replaced by a single tab extending throughout an effective arcuate length, or additional individual tabs can be spaced throughout this effective arcuate length without affecting the concept of the invention so long as the tab means meets the criteria described above.

Preferably the effective arcuate length is approximately 135° as shown in FIG. 2 of the drawings. This length, however, can vary from a maximum of 180° to a single tab having an arcuate length of a very few degrees spaced generally diameterically from locking key 33.

Accordingly, the improved trimming knife is simplified, provides an effective, safe, inexpensive and efficient device which achieves all the enumerated objectives, provides for eliminating difficulties encourtered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved meat trimming knife is constructed and used, the characteristics of the construction and the advantageous, new and useful results obtained; the new and useful structures, devices, elements, arrangements, parts and combinations, are set forth in the appended claims.

I claim:

1. An improved meat trimming knife including:

(a) a handpiece having a concavely shaped front end and a handle extending in a generally radial direction rearwardly from said front end;

(b) a ring-shaped blade holder adapted to be mounted on the concave front end of the handpiece;

(c) a ring-shaped cutting blade adapted to be rotatably mounted on the blade holder;

(d) a locking key slidably mounted in a complementary shaped keyway formed in the handpiece for releasably retaining the cutting blade on the blade holder;

(e) means operatively engaged with the locking key for locking said key in the blade retaining position; and (f) tab means formed integrally on the blade holder for releasably holding the cutting blade on the blade holder, with said tab means having an arcuate length of less than 160° and being shaped a predetermined arcuate distance from the locking key.

2. The meat trimming knife defined in claim 1 in which a spring biased pin is operatively engaged with the locking key to maintain said key in the blade retaining position.

3. The meat trimming knife defined in claim 2 in which a hole is formed in the handpiece adjacent the concave end; and in which a coil spring is seated in said hole and is engaged with the pin which is slidably mounted in said hole.

4. The meat trimming knife defined in claim 2 in which slot means is formed in the locking key for receiving the spring biased pin therein; and in which annular shoulder means is formed on the pin for engaging the slot means to maintain the pin in the blade retaining position.

5. The meat trimming knife defined in claim 1 in which the tab means includes a pair of tabs spaced approximately 135° apart.

6. The meat trimming knife defined in claim 5 in which one of said tabs is located approximately 105° from the locking key.

7. The meat trimming knife defined in claim 5 in which each of the tabs have an arcuate configuration each with an arcuate length of approximately 15°.

8. The meat trimming knife defined in claim 1 in which the blade holder has a diameter of approximately five inches.

9. The meat trimming knife defined in claim 1 in which the concavely shaped front end of the handpiece has an arcuate length of approximately 100°.

10. The meat trimming knife defined in claim 1 in which the tab means is formed integrally with the blade holder and forms an arcuate groove in which the cutting blade is slidably mounted.

* * * * *